US010116091B2

(12) United States Patent
Salgado et al.

(10) Patent No.: US 10,116,091 B2
(45) Date of Patent: Oct. 30, 2018

(54) CONNECTOR POSITION ASSURANCE DEVICE, CONNECTOR BOX AND ELECTRICAL CONNECTOR SYSTEM

(71) Applicants: Tyco Electronics France SAS, Pontoise (FR); TE Connectivity Germany GmbH, Bensheim (DE)

(72) Inventors: Carlos Salgado, Franconville (FR); Xavier Rouillard, Franconville (FR); Jonathan Benichou, Mannheim (DE); Rolf Jetter, Darmstadt (DE); Christian Boemmel, Langen (DE)

(73) Assignees: TE Connectivity German GmbH, Bensheim (DE); Tyco Electronics France SAS, Pontoise (FR)

( * ) Notice: Subject to any disclaimer, the term of this patent is extended or adjusted under 35 U.S.C. 154(b) by 0 days.

(21) Appl. No.: 15/459,732

(22) Filed: Mar. 15, 2017

(65) Prior Publication Data

US 2017/0271814 A1 Sep. 21, 2017

(30) Foreign Application Priority Data

Mar. 15, 2016 (FR) ..... 16 52200

(51) Int. Cl.
*H01R 13/629* (2006.01)
*H01R 13/627* (2006.01)

(52) U.S. Cl.
CPC ... *H01R 13/62927* (2013.01); *H01R 13/6272* (2013.01)

(58) Field of Classification Search
CPC ..... H01R 13/6271; H01R 13/6275
USPC ..... 439/352, 354
See application file for complete search history.

(56) References Cited

U.S. PATENT DOCUMENTS 4,946,404 A * 8/1990 Takenouchi ..... H01R 13/641 439/352
5,120,255 A 6/1992 Kouda et al.
5,839,915 A * 11/1998 Ford ..... H01R 13/641 439/350
6,261,115 B1 * 7/2001 Pederson ..... H01R 13/6272 439/352
6,780,045 B2 * 8/2004 Shuey ..... H01R 13/641 439/352
7,326,074 B1 * 2/2008 Lim ..... H01R 13/629 439/352
7,465,185 B2 * 12/2008 Tyler ..... H01R 13/506 439/352
7,470,138 B1 * 12/2008 Chen ..... H01R 13/506 439/352
7,544,081 B2 * 6/2009 Lim ..... H01R 13/4361 439/352

(Continued)

FOREIGN PATENT DOCUMENTS

WO 2012096948 A2 7/2012

*Primary Examiner* — Tulsidas C Patel
*Assistant Examiner* — Marcus Harcum
(74) *Attorney, Agent, or Firm* — Barley Snyder

(57) ABSTRACT

A connector position assurance device for an electrical connector comprises a body and a locking lance. The body has a body recess. The locking lance extends along a length of the body and has a fixed end fixed to the body and a lance head opposite the fixed end. The lance head is aligned with the body recess and is resiliently deflected from an undeformed position into the body recess.

13 Claims, 6 Drawing Sheets

(56) References Cited

U.S. PATENT DOCUMENTS

| | | | | |
|---|---|---|---|---|
| 7,909,638 | B2 * | 3/2011 | Seo | H01R 13/6272 439/352 |
| 8,016,606 | B1 * | 9/2011 | Kwan | H01R 13/641 439/352 |
| 8,920,187 | B2 * | 12/2014 | Kon | H01R 13/641 439/352 |
| 9,478,906 | B2 * | 10/2016 | Myer | H01R 13/6273 |
| 9,608,373 | B2 * | 3/2017 | Wu | H01R 13/639 |
| 9,893,464 | B2 * | 2/2018 | Endo | H01R 13/6271 |
| 2003/0096527 | A1 * | 5/2003 | Greiner | H01R 13/6272 439/352 |
| 2015/0295354 | A1 * | 10/2015 | Morello | H01R 13/6272 439/352 |

* cited by examiner

CONNECTOR POSITION ASSURANCE DEVICE, CONNECTOR BOX AND ELECTRICAL CONNECTOR SYSTEM

CROSS-REFERENCE TO RELATED APPLICATION

This application claims the benefit of the filing date under 35 U.S.C. § 119(a)-(d) of French Patent Application No. 1652200, filed on Mar. 15, 2016.

FIELD OF THE INVENTION

The present invention relates to an electrical connector, and more particularly, to a connector position assurance device for an electrical connector.

BACKGROUND

Electrical connectors comprising a receptacle connector, a plug connector insertable into the receptacle connector, and a connector position assurance device ("CPA device") are known in the art. The CPA device is used to ensure that a connection between the plug connector and the receptacle connector is maintained in environments subject to shocks or vibrations which, without a CPA device, might result in disconnection of the system.

U.S. Pat. No. 5,120,255 A discloses an electrical connector comprising male and female connectors as well as a locking detector element comprising a locking lance. The male connector comprises a locking element arranged on an external surface of the male connector box in a continuation of a window provided for receiving the locking detector element. When the male connector is inserted into the female connector, the locking detector element is housed in the window of the male connector. A locking stop, provided in the space in the female connector which receives the male connector, thus resiliently deflects the locking element of the male connector as well as the locking lance of the locking detector element. Subsequently, once the locking element of the male connector has passed beyond the locking stop of the female connector, locking the male and female connectors, the locking detector element can advance further in the window to a final position where the locking lance thereof maintains the locking of the electrical connector as a whole.

In conventional CPA device electrical connectors, in the event of shocks or vibrations, the locking elements of the CPA device which assure that a connection is maintained between a first connector and a second connector are subjected to high stresses. Further, if the CPA device is constantly subject to stresses, it is more susceptible to environmental variations and can thus be weakened.

International Patent Application WO 2012/096948 A2 discloses a CPA device comprising a central locking arm arranged between two lateral locking lances configured to establish locking to corresponding ledges of a female box in a pre-locking position. Before initiating plugging a male box into the female box, the CPA device has to be inserted into the female box as far as the pre-locking position, in which the CPA device is immobilized. During plugging, the central locking arm of the CPA device is deflected and released from the pre-locking position by translational contact with the edge of the male box.

Some known CPA devices, as described above, thus make it possible to alleviate in part the strains on the locking assurance element of the CPA device, but require pre-locking the CPA device to a first connector box, which requires an additional locking operation and corresponding additional locking elements which have to be provided on the CPA device. The connector is thus more complex and the use of the additional locking elements leads to new stresses. There is consequently a need in the art to reduce the stresses on the locking assurance elements of a CPA device while also avoiding or at least reducing the need for pre-locking so as to simplify the system and avoid the occurrence of additional stresses.

SUMMARY

A connector position assurance device for an electrical connector according to the invention comprises a body and a locking lance. The body has a body recess. The locking lance extends along a length of the body and has a fixed end fixed to the body and a lance head opposite the fixed end. The lance head is aligned with the body recess and is resiliently deflected from an undeformed position into the body recess.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
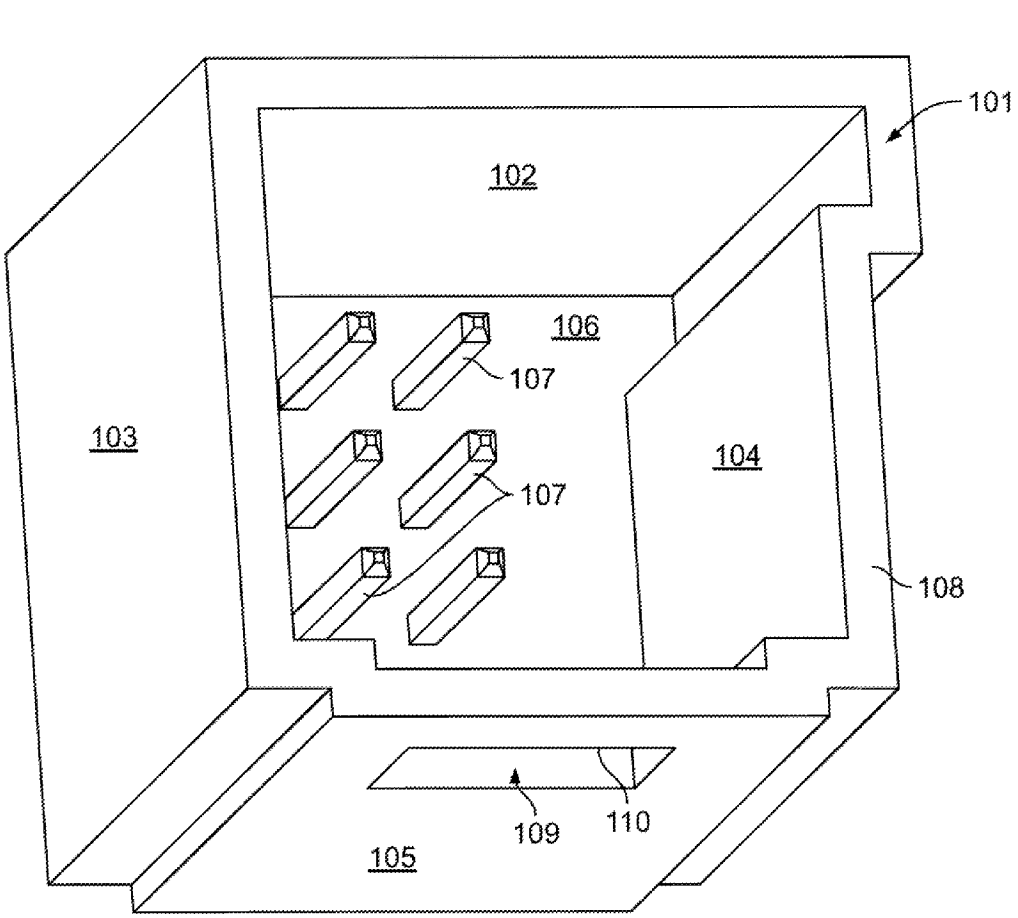
FIG. 1 is a perspective view of a receptacle connector of the electrical connector according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

Figure 2:
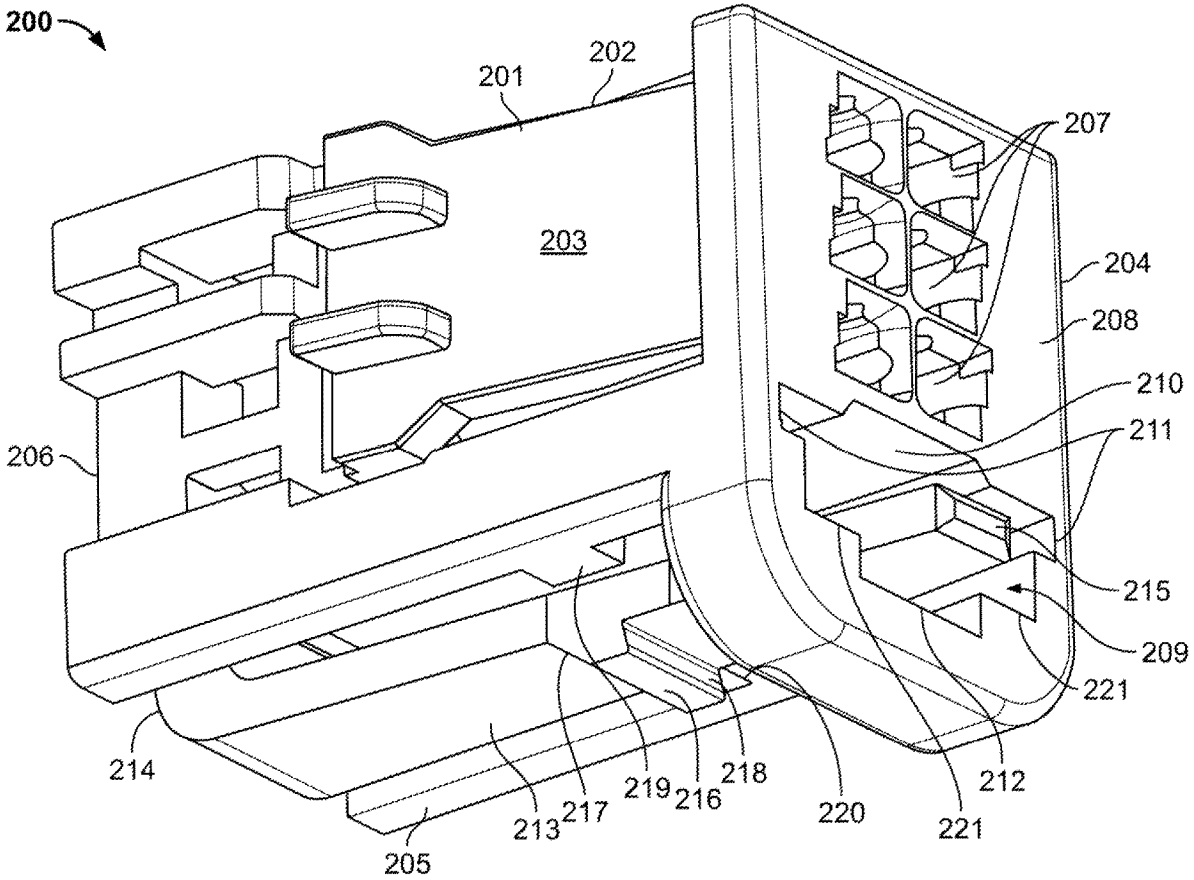
FIG. 2 is a perspective view of a plug connector of the electrical connector.
Figure 3:
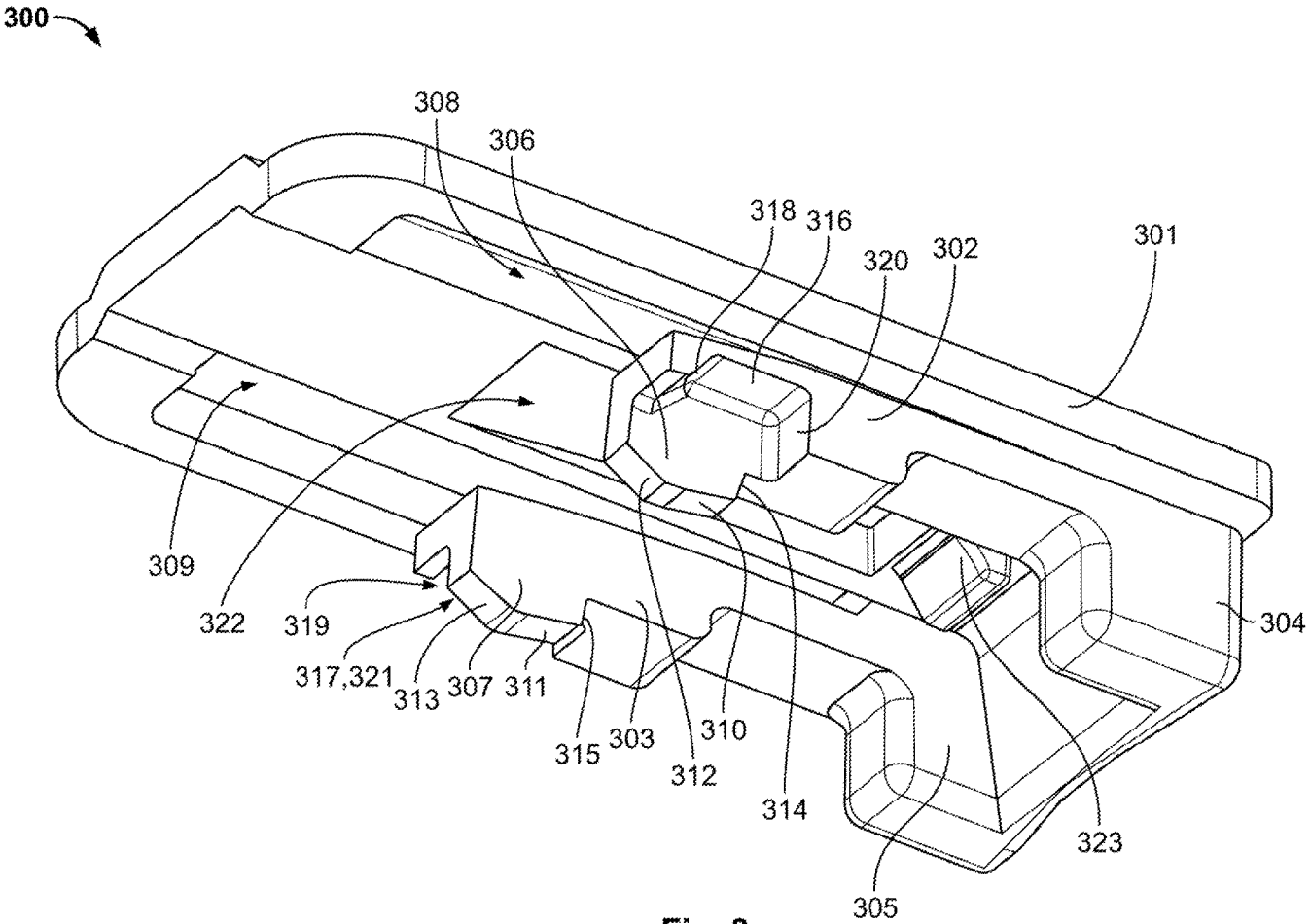
FIG. 3 is a perspective view of a connection position assurance device of the electrical connector.

An electrical connector according to the invention, as shown in FIGS. 1-3, has a receptacle connector 100, a plug connector 200, and a connector position assurance device ("CPA device") 300. The major components of the invention will now be described in greater detail.

The receptacle connector 100 is shown in FIG. 1. The receptacle connector 100 has a receptacle housing 101 formed of an upper wall 102, two opposing side walls 103, 104, a lower wall 105 opposite the upper wall 102, and a base wall 106. A plurality of electrical contact pins 107 are disposed on the base wall 106. In the embodiment shown in FIG. 1, the receptacle connector 100 has six electrical contact pins 107, however, as would be understood by one with ordinary skill in the art, the number of electrical contact pins 107 could be more than six or less than six. The base wall 106 is opposite an opening defined by a plurality of edges 108 of the receptacle housing 101. The lower wall 105 has a locking passageway 109 including a locking surface 110.

The plug connector 200 is shown in FIG. 2. The plug connector 200 is insertable into the receptacle connector 100. The plug connector 200 has a plug housing 201 formed of an upper wall 202, two opposing side walls 203, 204, a lower part 205 opposite the upper wall 202, and an opposite front wall 206 and rear wall 208. The front wall 206 and rear wall 208 comprising terminal passageways 207 extending through the plug connector 200. In the shown embodiment, the plug connector 200 has six terminal passageways 207, however, as would be understood by one with ordinary skill in the art, the number of terminal passageways 207 corresponds to the number of electrical contact pins 107.

The rear wall 208, as shown in FIG. 2, also has a CPA device passageway 209 extending through the plug connector 200. The CPA device passageway 209 is disposed below the terminal passageways 207 and extends along the lower part 205. The lower part 205 and the CPA device passageway 209 form a space suitable for receiving the CPA device 300. The CPA device passageway 209 has an upper recess 210 extending substantially in the direction of the terminal passageways 207, two opposite lateral recesses 211 extending substantially in the direction of the side walls 203, 204, and a lower recess 212 opposite the upper recess 210. The CPA device passageway 209 is a shape and dimensions adapted to facilitate the insertion of the CPA device 300 while minimizing the stresses exerted thereon.

The lower part 205, as shown in FIG. 2, has a locking arm 213 extending in a longitudinal direction of the plug connector 200, the longitudinal direction corresponding to an insertion direction of the plug connector 200 into the receptacle connector 100. The locking arm 213, as described in greater detail below, locks the plug connector 200 to the receptacle connector 100. A first end 214 of the locking arm 213 is fixed to the front wall 206 while an opposite second end 215 of the locking arm 213 extends substantially as far as the CPA device passageway 209 of the rear wall 208. The locking arm 213 has a locking stop 216 of which a front wall 217 is beveled so as to make it possible, upon contact with the edges 108 of the receptacle connector 100, for the arm 213 to be deflected or resiliently displaced upward in the receiving space for the CPA device 300. The locking arm 213 has a locking surface 218 opposite the front wall 217. The lower part 205 further comprises a pair of lateral locking stops 219, 220 projecting toward the locking arm 213 from the side walls 203, 204, respectively. The lateral locking stops 219, 220 are aligned in a transverse direction of the plug connector 200 with the locking stop 216 of the locking arm 213.

The CPA device 300 is shown in FIG. 3. The CPA device 300, as described in greater detail below, maintains a locking of the plug connector 200 and the receptacle connector 100. The CPA device 300 has a body 301 and a pair of locking lances 302, 303 which extend parallel along the body 301. In other embodiments, the CPA device 300 may only have one locking lance 302 or 303, or may have more than two locking lances 302, 303.

As shown in FIG. 3, each of the locking lances 302, 303 has a fixed end 304, 305 fixed to the body 301 of the CPA device 300 and a lance head 306, 307 at an opposite end of the locking lance 302, 303. The body 301 has body recesses 308, 309 permitting deflection of the lances 302, 303. Each lance head 306, 307 has a locking stop 310, 311 configured to lock the CPA device 300 to the receptacle connector 100. Each locking stop 310, 311 has a beveled surface 312, 313 and a locking surface 314, 315. Each lance head 306, 307 also has a lance recess 316, 317 aligned with the stop 310, 311.

The body 301, as shown in FIG. 3, also has a body opening 322 disposed between the body recesses 308, 309 and a body projection 323 disposed between the fixed ends 304, 305 of the locking lances 302, 303. The body projection 332 projects from a lower face of the body 301 to which the fixed ends 304, 305 of the locking lances 302, 303 are fixed.

A sequence for coupling and locking the electrical connector including the receptacle connector 100, the plug connector 200, and the CPA device 300 will now be described in greater detail with reference to FIGS. 4A-4D. The arrow I shown in FIGS. 4A-4D indicates an insertion direction of the plug connector 200 and CPA device 300 into the receptacle connector 100. Because of the cross-section of FIGS. 4A-4D, only half of the elements of the CPA device 300 are illustrated, by way of the locking lance 303. Nevertheless, it is clear that the elements not shown behave analogously to the elements shown. Thus, for example, the locking lance 302 behaves like the locking lance 303.

Figure 4A:
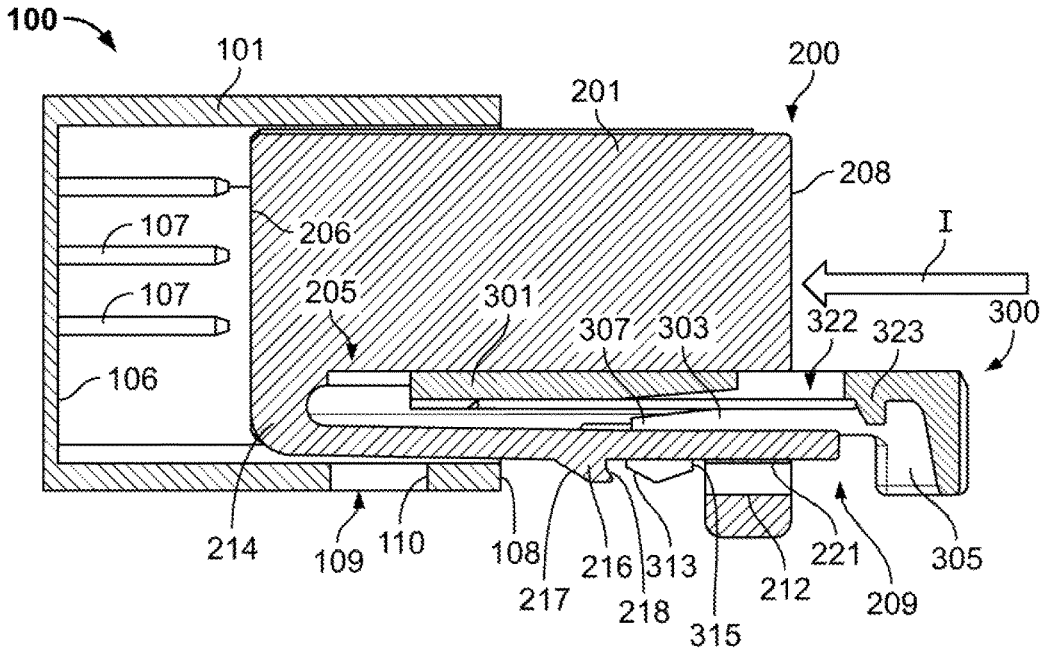
FIG. 4A is a sectional side view of the electrical connector in a first unlocked state.

A first unlocked state of the electrical connector is shown in FIG. 4A. The plug connector 200 is inserted into the receptacle housing 101 in the insertion direction I. The front wall 206 faces an opening of the receptacle connector 100 defined by the edges 108 during insertion. In the first unlocked state, the CPA device 300 is inserted, without force and without undergoing stress, through the CPA device passageway 209 into a predefined space suitable for receiving the CPA device 300 at the lower part 205 of the plug connector 200. The body 301 passes into the upper 210 and lateral 211 recesses of the CPA device passageway 209 without the locking lances 302, 303 being deflected. The lance heads 306, 307 pass through edges 221 on either side of the lower recess 212 without being deflected. There are therefore no stresses on the elements of the CPA device 300. The connector plug connector 200 starts to be inserted, in the insertion direction I into the receptacle connector 100, but there is no electrical contact with the electrical contact pins 107. The elements of the electrical connector which can be resiliently deflected, such as the locking arm 213 and the locking lances 302, 303, are in undeformed rest positions.

Figure 4B:
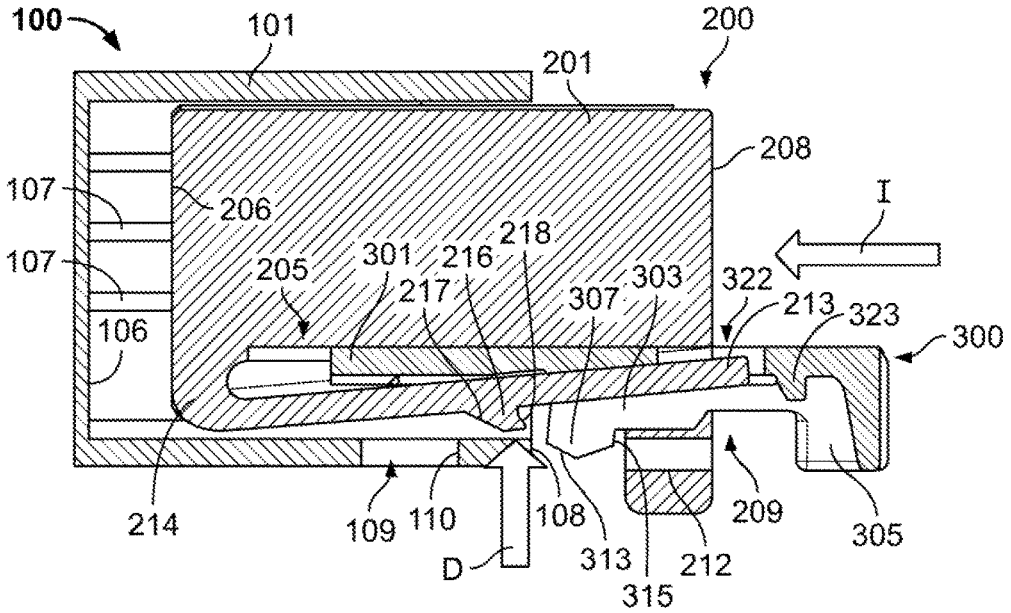
FIG. 4B is a sectional side view of the electrical connector in a second unlocked state.

A second unlocked state, in which the plug connector 200 has been inserted further into the receptacle connector 100 in the insertion direction I than in the first unlocked state, is shown in FIG. 4B. The electrical contact pins 107 are partially inserted into the terminal passageways 207. The pressure of the beveled front wall 217 of the locking arm 213 on the edge 108 during insertion deflects the locking arm 213 in the direction represented by the arrow D. The locking arm 213 is deflected into the body opening 322. In the second unlocked state, the beveled surfaces 312, 313 of the locking lances 302, 303 have not yet reached the edge 108 of the receptacle connector 100, and consequently, the locking lances 302, 303 are not deflected. Further, the projection 323 prevents the CPA device 300 from advancing in the insertion direction I while the locking arm 213 is still in the bent position in the body opening 322, securing against displacement of the CPA device 300 in the insertion direction I. The projection 323 ensures that the CPA device 300 cannot advance, and thus lock the electrical connector, until the homologous receptacle connector 100 and the plug connector 200 are correctly plugged together.

Figure 4C:
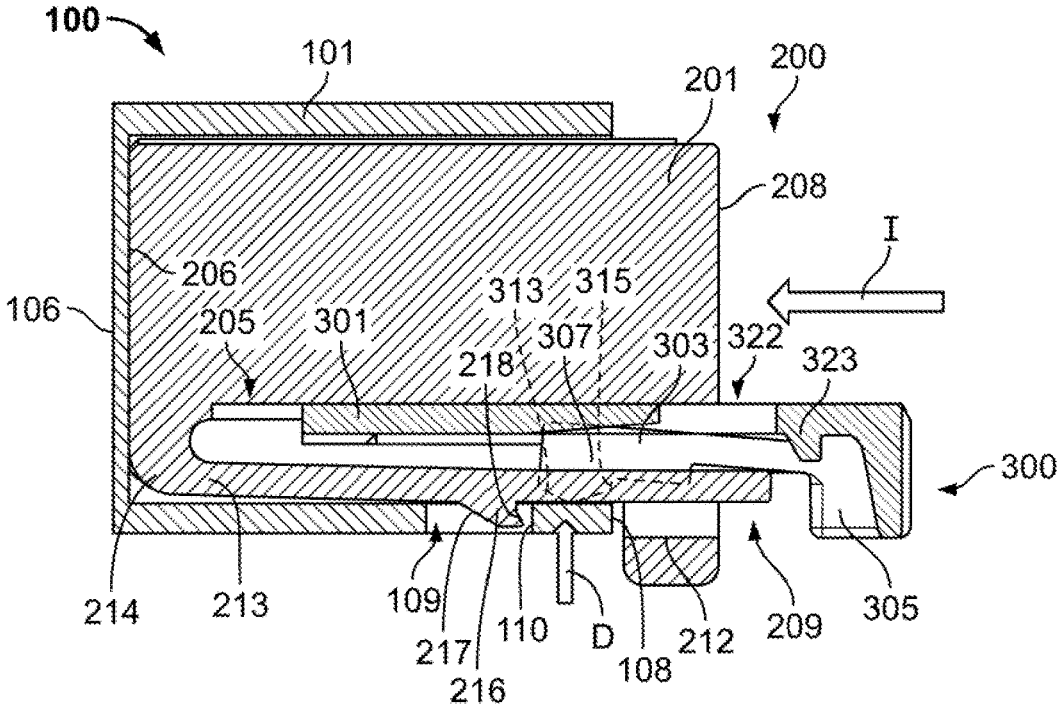
FIG. 4C is a sectional side view of the electrical connector in a partial locked state.

A partial locked state in which the plug connector 200 is locked to the receptacle connector 100 is shown in FIG. 4C. From the second unlocked state, the plug connector 200 is further inserted into the receptacle connector 100 along the insertion direction I until the front wall 206 and the base wall 106 abut against one another. The electrical contact pins 107 are completely plugged into the terminal passageways 207. The locking arm 213 is returned from the deflected position and the locking stop 216 is disposed in the locking passageway 109, in such a way that a movement of the plug connector 200 counter to the insertion direction I would lead to the locking surface 218 abutting against the locking surface 110. In the first locked state, the CPA device 300 has not yet been pushed further into the plug connector 200, but the locking lances 302, 303 are deflected in the direction represented by the arrow D by the pressure of the beveled surfaces 312, 313 on the edge 108 of the receptacle connector 100. The locking lances 302, 303 are deflected into the body recesses 308, 309. The CPA device 300 is not yet in the position for assuring that the locking between the receptacle connector 100 and the plug connector 200 is maintained; it would be possible to disconnect the receptacle connector 100 and the plug connector 200 by pressing on the locking stop 216 so as to deflect the locking arm 213, permitting withdrawal of the plug connector 200.

Figure 4D:
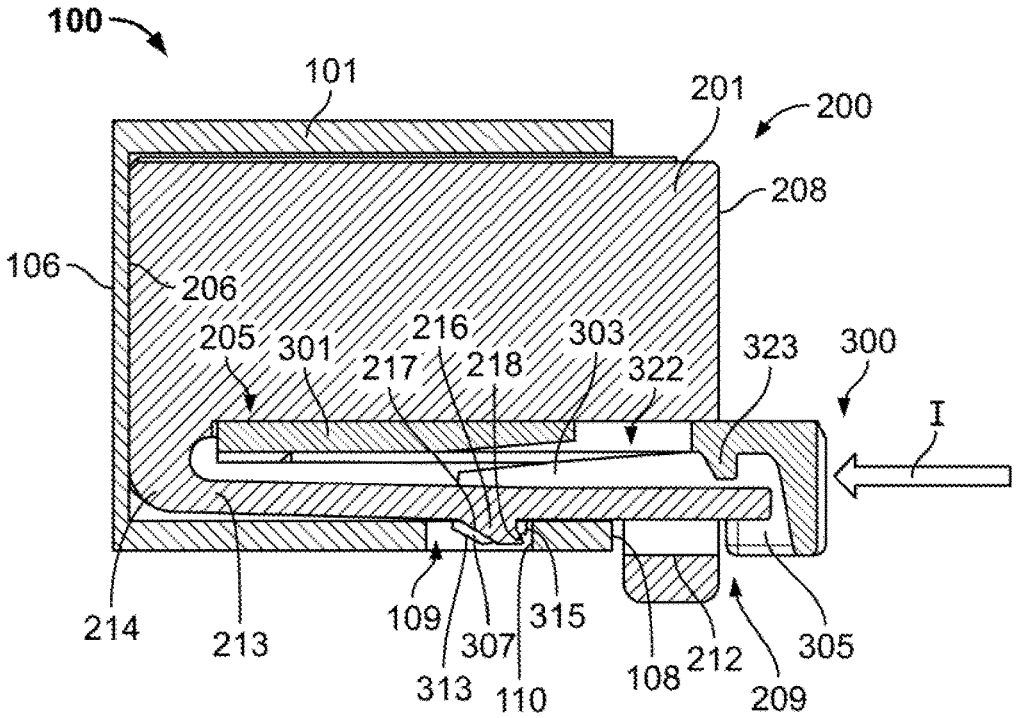
FIG. 4D is a sectional side view of the electrical connector in a complete locked state.

A complete locked state in which the CPA device 300 maintains the locking between the receptacle connector 100 and the plug connector 200 is shown in FIG. 4D. From the partial locked state, the CPA device 300 is pushed into the plug connector 200 in the insertion direction I until the lance heads 306, 307 reach the locking passageway 109. The lance heads 306, 307 return to an undeformed position and the locking surfaces 314, 315 lock the CPA device 300 to the receptacle connector 100 by abutting against the locking surface 110. At the same time, the resilient motion of the lance heads 306, 307 into the undeformed positions thereof has made it possible for the lance recesses 316, 317 to fall back so as to engage the lateral locking stops 219, 220 between the beveled surfaces 318, 319 and an opposing lance surfaces 320, 321, further ensuring the locking of the CPA device 300 to the plug connector 200. Because each lance head 306, 307 locks the CPA device 300 to the receptacle connector 100 and to the plug connector 200, the same element of the CPA device 300 locks it to each of the receptacle connector 100 and the plug connector 200, instead of using different parts of the CPA device as in some conventional devices. Further, the projection 323 prevents the locking arm 213 from being deflected in the direction D.

To disconnect the electrical connector, an operation which is substantially the reverse of the operation described above is carried out. The lance heads 306, 307 are manually deflected and the CPA device 300 is disengaged by moving the beveled surfaces 318, 319 over the lateral locking stops 219, 220. In doing so, the configuration of the CPA device passageway 209, and in particular of the profile defined by the edges 221, makes it possible to reduce, or even eliminate, additional stresses which may be exerted in particular on the lance heads 306, 307 during this operation.

Figure 5:
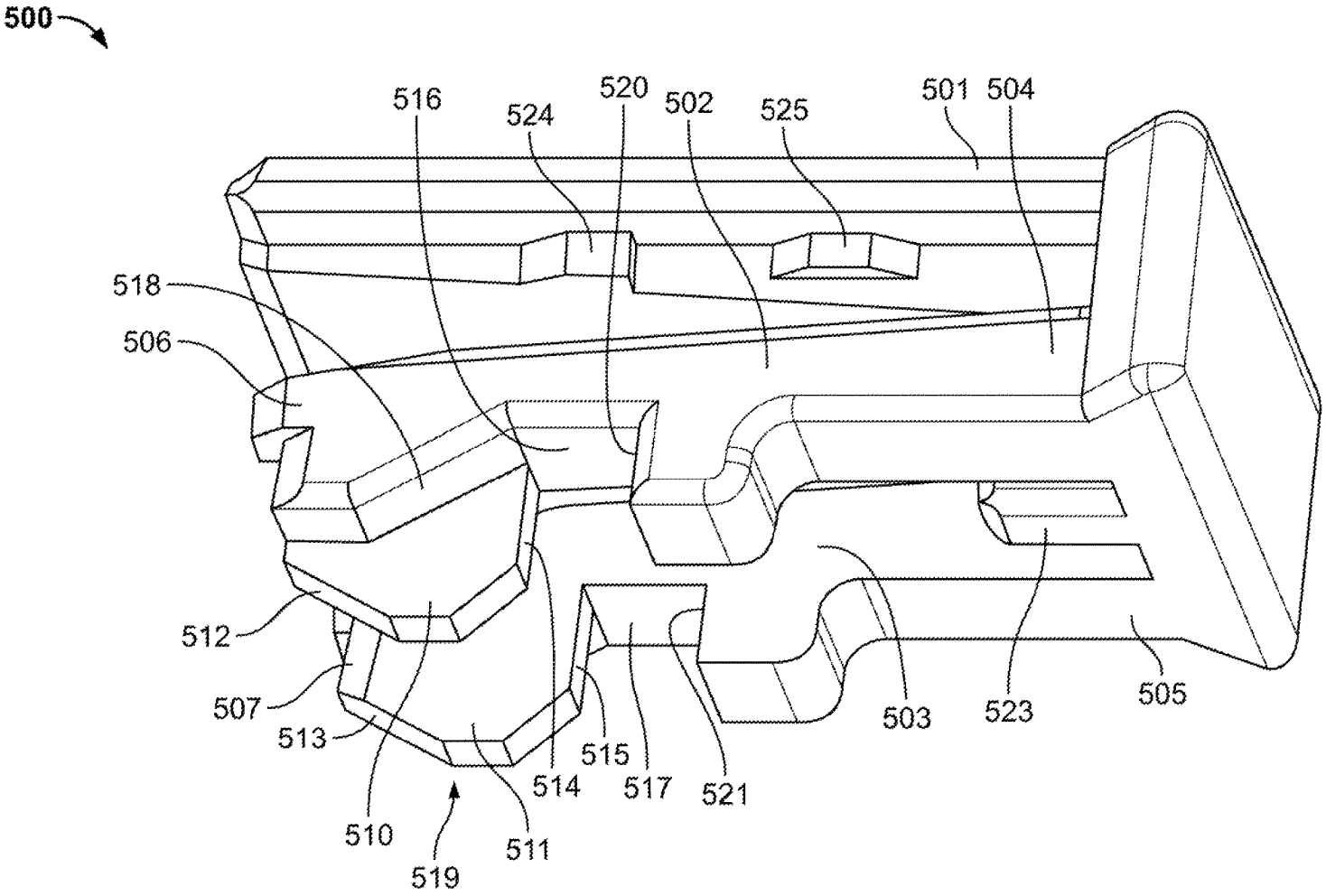
FIG. 5 is a perspective view of another connection position assurance device according to the invention.

A CPA device 500 according to another embodiment of the invention is shown in FIG. 5. The CPA device 500, similarly to the CPA device 300, maintains a locking of the plug connector 200 and the receptacle connector 100.

The CPA device 500, as shown in FIG. 5, has a body 501 and a pair of locking lances 502, 503 which extend parallel along the body 501. In other embodiments, the CPA device 500 may only have one locking lance 502 or 503, or may have more than two locking lances 502, 503.

As shown in FIG. 5, each of the locking lances 502, 503 has a fixed end 504, 505 fixed to the body 501 and a lance head 506, 507 at an opposite end of the locking lance 502, 503. The body 501 and the locking lances 502, 503 are formed at a non-zero angle to permit deflection of the lances 502, 503 toward the body 501; the locking lances 502, 503 and the body 501 are arranged in a V-shape as shown in FIG. 5.

Each lance head 506, 507 has a locking stop 510, 511 configured to lock the CPA device 500 to the receptacle connector 100. Each locking stop 510, 511 has a beveled surface 512, 513 and a locking surface 514, 515. Each lance head 506, 507 also has a lance recess 516, 517 aligned with the stop 510, 511 and having a beveled surface 518, 519 and an opposing lance surface 520, 521.

The body 501, as shown in FIG. 5, also has a body projection 523 disposed between the fixed ends 504, 505 of the locking lances 502, 503. The body projection 523 projects from a portion of the body 501 forming the apex of the V-shape.

A sequence for coupling and locking the electrical connector including the receptacle connector 100, the plug connector 200, and the CPA device 500 will now be described in greater detail with reference to FIGS. 4A-4D describing the analogous CPA device 300.

In a step analogous to the first unlocked state shown in FIG. 4A, the CPA device 500 is inserted substantially without force into the space defined by the lower part 205 and the CPA device passageway 209 of the connector plug connector 200. There are therefore substantially no stresses on elements of the CPA device 500. Optionally, as is shown in FIG. 5, the CPA device 500 may further comprise stops 524 and/or surfaces 525 projecting from each side of the body 501 so as to prevent unintended premature withdrawal of the CPA device 500 from the plug connector 200. The CPA device 500 can thus be inserted in part into the space defined by the lower part 205 and the CPA device passageway 209, and the connector plug connector 200 can start to be inserted into the receptacle connector 100 in the insertion direction I as described previously. The elements of the electrical connector which can be resiliently deflected, such as the locking arm 213 and the locking lances 502, 503, are in undeformed positions.

In a step analogous to the second unlocked state shown in FIG. 4B, when the pressure of the beveled surface 217 of the locking arm 213 on the edge 108 leads to the locking arm 213 being deflected as described above, the locking arm 213 is deflected as far as the V-shape of the body 501 with the locking lances 502, 503 of the CPA device 500 provides sufficient space for the deflection of the locking arm 213. The beveled surfaces 512, 513 of the locking lances 502, 503 have not yet reached the wall 108 of the receptacle connector 100, and so the locking lances 502, 503 of the CPA device 500 are still in the undeformed positions thereof. Further, as described above, the projection 523 prevents the CPA device 500 from advancing in the insertion direction I while the locking arm 213 is still in the bent position, thus providing security against displacement of the device 500 in the insertion direction I while the locking arm 213 has not returned to the undeformed position. The projection 523 ensures that the CPA device 500 cannot advance, and thus lock the electrical connector, until the receptacle connector 100 and the plug connector 200 are correctly plugged together.

In a step analogous to the partial locking state shown in FIG. 4C, when the plug connector 200 is correctly inserted into the receptacle connector 100 as described above, in particular the locking arm 213 having returned to the undeformed position thereof and the locking stop 216 being disposed in the locking passageway 109, the locking lances 502, 503 are deflected from the V-shape by the pressure of the beveled surfaces 512, 513 on the edge 108 of the receptacle connector 100. The CPA device 500 is not yet in the position for assuring that the locking between the receptacle connector 100 and the plug connector 200 is maintained; it would be possible to disconnect the receptacle connector 100 and the plug connector 200 by pressing on the locking stop 216 so as to deflect the locking arm 213, permitting withdrawal of the plug connector 200.

In a step analogous to the complete locked state shown in FIG. 4D, the CPA device 500 maintains the locking between the receptacle connector 100 and the plug connector 200. The CPA device 500 is inserted into the plug connector 200 in the insertion direction I until the lance heads 506, 507 reach the locking passageway 109. The lance heads 506, 507 return to an undeformed position and the locking surfaces 514, 515 lock the CPA device 500 to the receptacle connector 100 by abutting against the locking surface 110. At the same time, the resilient motion of the lance heads 506, 507 into the undeformed positions thereof has made it possible for the lance recesses 516, 517 to fall back so as to engage the lateral locking stops 219, 220 between the beveled surfaces 518, 519 and an opposing lance surfaces 520, 521, further ensuring the locking of the CPA device 500 to the plug connector 200. Further, the projection 523 prevents the locking arm 213 from being deflected in the direction D.

Disconnection is analogous to that describe for the CPA device 300. The lance heads 506, 507 are manually deflected and the CPA device 500 is disengaged by moving the beveled surfaces 518, 519 over the lateral locking stops 219, 220. In doing so, the configuration of the CPA device passageway 209, and in particular of the profile defined by the edges 221, makes it possible to reduce, or even eliminate, additional stresses which may be exerted in particular on the lance heads 506, 507 during this operation.

A person skilled in the art will also understand that the aspects and features of the CPA devices 300, 500 can be combined with one another to form other advantageous variants of a CPA device without departing from the present invention. It is thus conceivable to provide a CPA device comprising both the deflection spaces 308, 309 and/or 322 as described in relation to the CPA device 300 of FIG. 3 and a V-shape as described in reference to the CPA device 500 of FIG. 5.

It can be seen from the above description that a CPA device according to a variant of an aspect of the present invention may comprise at least one locking element, for example the two locking lances 302, 303 of the CPA device 300, which may be provided so as to be substantially parallel to the locking arm 213 of the plug connector 200. In a variant of another aspect, at least one locking element, for example the two locking lances 502, 503 of the CPA device 500, may be provided at an angle to the locking arm 213. In all cases, it is thus possible to provide a CPA device of which at least one locking lance bends in a same direction as the locking arm 213.

What is claimed is:

1. A connector position assurance device, comprising:

a body having a body recess; and a locking lance extending along a length of the body, the locking lance having a fixed end fixed to the body and a lance head opposite the fixed end, the lance head aligned with the body recess, resiliently deflecting from an undeformed position into the body recess, and having a lance recess and a locking stop aligned with the lance recess, the lance recess locking to a plug connector having a locking arm, the locking stop and the locking arm locking to a locking surface of a receptacle connector matable with the plug connector.

2. The connector position assurance device of claim 1, wherein the lance recess has a surface engaging a lateral locking stop of the plug connector.

3. The connector position assurance device of claim 2, wherein the surface of the lance recess is a beveled surface.

4. The connector position assurance device of claim 1, wherein the locking stop projects away from the body.

5. A connector position assurance device, comprising:

a body; and a locking lance extending along a length of the body, the locking lance having a fixed end fixed to the body and a lance head opposite the fixed end, the body and the locking lance forming an angle in an undeformed position having an apex at the fixed end of the locking lance, the lance head resiliently deflecting from the undeformed position toward the body and having a lance recess and a locking stop aligned with the lance recess, the lance recess locking to a plug connector having a locking arm, the locking stop and the locking arm locking to a locking surface of a receptacle connector matable with the plug connector.

6. An electrical connector, comprising:

a connector position assurance device including a body and a locking lance extending along a length of the body, the locking lance having a fixed end fixed to the body and a lance head opposite the fixed end, the lance head resiliently deflecting from an undeformed position toward the body and having a lance recess and a locking stop aligned with the lance recess;

a receptacle connector, the locking stop locking to the receptacle connector; and a plug connector matable with the receptacle connector, the plug connector having a connector position assurance device passageway receiving the connector position assurance device and a locking arm resiliently deflecting into the connector position assurance device passageway, the lance recess locking to the plug connector, and when the connector position assurance device is fully inserted into the connector position assurance device passageway, the locking stop locks to a locking surface of the receptacle connector and the locking arm locks to the locking surface of the receptacle connector.

7. The electrical connector of claim 6, wherein the locking arm locks the plug connector to the receptacle connector.

8. The electrical connector of claim 7, wherein the body of the connector position assurance device has a body opening into which the locking arm deflects.

9. The electrical connector of claim 6, wherein the body of the connector position assurance device has a body projection preventing the connector position assurance device from being further inserted into the connector position assurance device passageway when the locking arm is in a deflected position.

10. The electrical connector of claim 9, wherein the body projection prevents the locking arm from being deflected when the plug connector and the receptacle connector are locked to one another and the connector position assurance device is fully inserted into the connector position assurance device passageway.

11. The electrical connector of claim 6, wherein the connector position assurance device passageway has a lower recess defined by a plurality of edges of the plug connector.

12. The electrical connector of claim 11, wherein, when the connector position assurance device is received in the connector position assurance device passageway, the lance head passes through the lower recess without being deflected.

13. The connector position assurance device of claim 1, wherein the lance recess locks to the plug connector simultaneously with the locking stop locking to the receptacle connector.

* * * * *